US006784906B2

(12) United States Patent
Long et al.

(10) Patent No.: US 6,784,906 B2
(45) Date of Patent: Aug. 31, 2004

(54) DIRECT THERMAL PRINTER

(75) Inventors: John Long, West Chester, OH (US); Richard B. Moreland, Centerville, OH (US)

(73) Assignee: NCR Corporation, Dayton, OH (US)

( * ) Notice: Subject to any disclaimer, the term of this patent is extended or adjusted under 35 U.S.C. 154(b) by 40 days.

(21) Appl. No.: 10/022,956

(22) Filed: Dec. 18, 2001

(65) Prior Publication Data

US 2003/0112318 A1 Jun. 19, 2003

(51) Int. Cl.[7] ..... B41J 2/32; B41J 11/00

(52) U.S. Cl. ..... 347/171; 347/173

(58) Field of Search ..... 347/171, 173, 347/197, 227, 220, 222, 212; 400/120.16, 120.18, 691, 693

(56) References Cited

U.S. PATENT DOCUMENTS

| | | | | |
|---|---|---|---|---|
| 3,947,854 A | | 3/1976 | Hansen et al. | 347/97 |
| 4,167,392 A | | 9/1979 | Defago | 8/471 |
| RE30,116 E | | 10/1979 | Maalouf | 503/204 |
| 4,708,500 A | | 11/1987 | Bangs et al. | 400/120.17 |
| 4,956,251 A | | 9/1990 | Washizu et al. | 430/138 |
| 4,965,166 A | | 10/1990 | Hosoi et al. | 438/156 |
| 5,055,373 A | | 10/1991 | Saeki et al. | 430/138 |
| 5,101,222 A | | 3/1992 | Hakkaku | 347/175 |
| 5,132,704 A | * | 7/1992 | Nakagawa | 347/197 |
| 5,196,297 A | | 3/1993 | Dombrowski, Jr. et al. | 430/338 |
| 5,214,750 A | | 5/1993 | Minowa et al. | 358/1.12 |
| 5,266,550 A | | 11/1993 | Asajima et al. | 503/227 |
| 5,284,816 A | | 2/1994 | Stephenson | 503/227 |
| 5,398,305 A | | 3/1995 | Yawata et al. | 358/1.1 |
| 5,428,714 A | | 6/1995 | Yawata et al. | 358/1.13 |
| 5,437,004 A | | 7/1995 | Miyasaka et al. | 358/1.12 |
| 5,555,349 A | | 9/1996 | Miyasaka et al. | 358/1.12 |
| 5,584,590 A | | 12/1996 | Ito et al. | 400/605 |

(List continued on next page.)

FOREIGN PATENT DOCUMENTS

| | | | | |
|---|---|---|---|---|
| EP | 0947340 A | | 10/1999 | |
| GB | 2 250 478 A | * | 10/1992 | B41J/25/316 |
| JP | 57-208298 | | 12/1982 | |

OTHER PUBLICATIONS

JP Abstract vol. 007, No. 081 (M–105), Apr. 5, 1983 & JP 58008668 A (Shinko Denki KK), Jan. 18, 1983.

JP Abstract vol. 015, No. 194 (M–1114), May 20, 1991 & JP 03051149 A (Fujitsu General Ltd), Mar 5, 1991.

JP Abstract vol. 2000, No. 24, May 11, 2001 & JP 2001 199095 A (Alps Electric Co Ltd.), Jul. 24, 2001.

JP Abstract vol. 1998, No. 08, Jun. 30, 1998 & JP 10076713 A (Sony Corp), Mar. 24, 1998.

JP Abstract vol. 010, No. 151 (M–483), May 31, 1986 & JP 61003765 A (Konishiroku Shashin Kogyo KK), Jan. 9, 1986.

*Primary Examiner*—K. Feggins
(74) *Attorney, Agent, or Firm*—Millen, White Zelano & Branigan PC

(57) ABSTRACT

The present invention provides a direct thermal printer, which may include first and second printheads and first and second platens. The first printhead can be positioned proximate to a first platen, and a second printhead can be positioned proximate to a second platen. Generally, the first printhead is in a substantially opposed relation to the second platen and the second printhead is in a substantially opposed relation to the first platen.

10 Claims, 4 Drawing Sheets

U.S. PATENT DOCUMENTS 5,594,653 A 1/1997 Akiyama et al. ..... 700/117
5,629,259 A 5/1997 Akada et al. ..... 503/227
5,639,169 A 6/1997 Aruga ..... 400/605
5,677,722 A 10/1997 Park ..... 347/218
5,692,110 A 11/1997 Miyasaka et al. ..... 358/1.12
5,707,925 A 1/1998 Akada et al. ..... 503/227
5,710,094 A 1/1998 Minami et al. ..... 503/204
5,755,521 A 5/1998 Ito et al. ..... 400/605
5,756,188 A 5/1998 Reiter et al. ..... 435/6
5,763,356 A 6/1998 Ueno et al. ..... 503/227
5,789,340 A 8/1998 Brust et al. ..... 503/227
5,792,725 A 8/1998 Simpson et al. ..... 503/229
5,794,530 A 8/1998 Dobashi et al. ..... 101/409
5,800,081 A 9/1998 Teradaira et al. ..... 400/74
5,815,191 A 9/1998 Michielsen et al. ..... 347/188
5,846,900 A 12/1998 Reiter et al. ..... 503/227
5,876,836 A 3/1999 Imamura et al. ..... 428/195
5,883,043 A 3/1999 Halbrook, Jr. et al. ..... 503/204
5,886,725 A * 3/1999 Miyadera et al. ..... 347/197
5,918,910 A 7/1999 Stillwagon et al. ..... 283/67
5,964,541 A 10/1999 Murison et al. ..... 400/188
6,095,414 A 8/2000 Long et al. ..... 235/385
6,130,185 A 10/2000 Narita et al. ..... 503/227
6,210,777 B1 4/2001 Vermeulen et al. ..... 428/195
6,388,692 B1 * 5/2002 Iwata et al. ..... 503/212

* cited by examiner

DIRECT THERMAL PRINTER

FIELD OF THE INVENTION

The invention relates to direct thermal printers, particularly direct thermal printers for dual-sided imaging.

BACKGROUND OF THE INVENTION

Direct thermal printers are used in many applications to provide information to a user. Often, information is provided only on one side of a paper receipt. It is desirable to be able to provide variable information on both sides of the receipt to save materials and to provide flexibility in providing information. Representative documentation in the area of dual-sided thermal printing includes the following patents:

U.S. Pat. No. 5,101,222, issued to Kunio Hakkaku on Mar. 31, 1992, discloses a thermal recording material comprising a magenta-pigment layer, a yellow-pigment layer, a cyan-pigment layer, and a polyester film (PET). The thermal recording material can be heat-processed by two opposing recording heads.

U.S. Pat. No. 4,956,251, issued to Washizu et al. on Sep. 11, 1990, discloses an apparatus that can be equipped with a double thermal head, which enables simultaneous heat recording on both sides. This patent also discloses Japanese patent application (OPI) No. 208298/82, and describes the Japanese patent as disclosing printing on both sides of an opaque support.

However, these references fail to disclose a direct thermal printer for dual-sided imaging with a compact construction.

SUMMARY OF THE INVENTION

One feature of the present invention provides a compact construction by providing a first printhead in a substantially opposed relation to a second platen and a second printhead in a substantially opposed relation to a first platen. Another feature of the present invention permits activating one side of an image element prior to activating the other side.

One embodiment of the present invention relates to a direct thermal printer, which may include first and second printheads and first and second platens. The first printhead can be positioned proximate to a first platen, and a second printhead can be positioned proximate to a second platen. Generally, the first printhead is in a substantially opposed relation to the second platen and the second printhead is in a substantially opposed relation to the first platen.

Another embodiment of the present invention relates to a direct thermal printer for dual-sided imaging, which may include first and second printhead assemblies. Generally, the first printhead assembly includes a first arm coupled or formed integrally with a first printhead, and coupled to a first platen; and the second printhead assembly includes a second arm coupled or formed integrally with a second printhead, and coupled to a second platen. The first printhead can be in a substantially opposed relation to the second platen and the second printhead can be in a substantially opposed relation to the first platen.

Still another embodiment of the present invention relates to a direct thermal printer, which may include a first means for direct thermal printing positioned proximate to a first support means, and a second means for direct thermal printing positioned proximate to a second support means. Generally, the first means for direct thermal printing is in a substantially opposed relation to the second support means and the second means for direct thermal printing is in a substantially opposed relation to the first support means.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
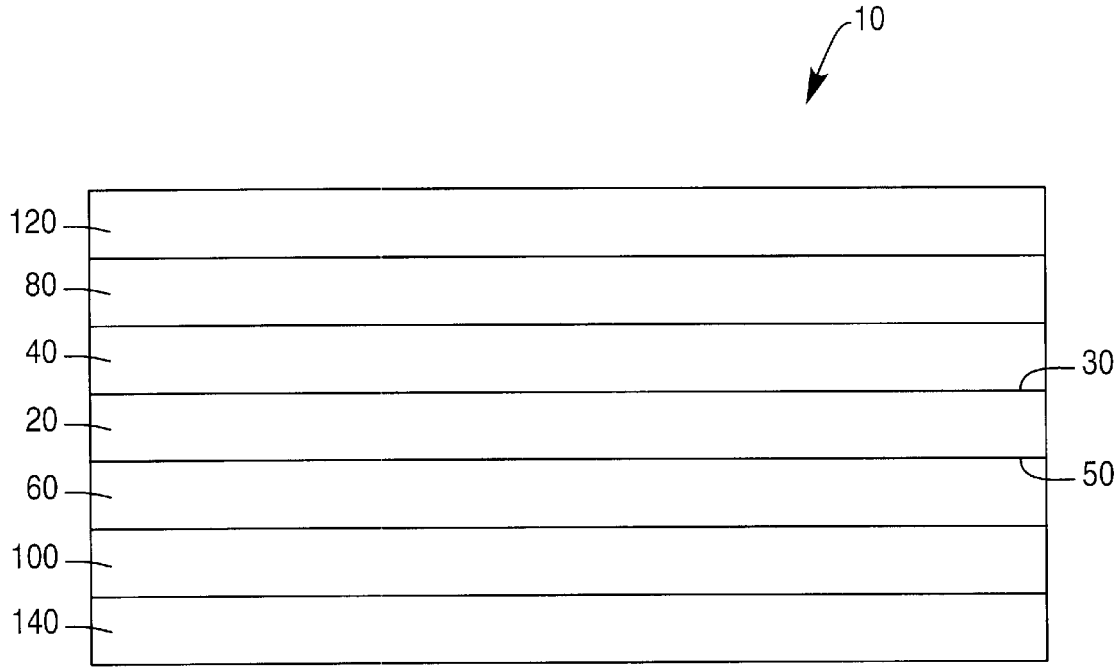
FIG. 1 illustrates a schematic cross-sectional view of an exemplary image element.

As depicted in FIG. 1, one embodiment of an image element 10 of the present invention may include a substrate 20 having a first surface 30 and a second surface 50, a first primer 40, a second primer 60, a first coating 80, a second coating 100, a first top coat 120, and a second top coat 140. Preferably, the first primer 40 is applied to the first surface 30 and the second primer 60 is applied to the second surface 50 using any suitable means such as flooding and metering, and subsequently drying. Generally, flooding with an aqueous coating mixture and then metering off the excess accomplish applying the primers. The first and second coatings 80 and 100 can be applied, respectively, to the first and second primers 40 and 60 using any suitable means such as flooding and metering, and subsequently drying. Optionally, the first and second top coats 120 and 140 can be applied, respectively, to the first and second coatings 80 and 100 using any suitable means such as flooding and metering. In another desired embodiment, an image element may omit the first and second primers 40 and 60 and the top coats 120 and 140, and merely include the first and second coatings applied directly to respective first and second surfaces of a substrate. The coatings may be applied using any suitable means, such as flooding and metering, and subsequently drying. Alternatively, spraying or dipping may be used instead of flooding and metering, with respect to applying the primers, coatings, and top coats. The image element 10 may have a basis weight of about 13 pounds (5.9 kilograms)—about 180 pounds (82 kilograms) per standard ream (500 sheets of 17" (43 cm)×22" (56 cm) paper), preferably about 13 pounds (5.9 kilograms)—about 100 pounds (45 kilograms) per standard ream, and more preferably of about 13 pounds (5.9 kilograms)—about 21 pounds (9.5 kilograms) per standard ream. Alternatively, an image element 10 having a basis weight less than 13 pounds (5.9 kilograms) may also be used. Furthermore, the image element 10 can be manufactured with any suitable process or apparatus, such as a conventional paper coating machine. Desirably, the image element 10 has a thickness less than two back-to-back conventional, i.e., one-sided printable thermal sheets.

Preferably, the substrate includes a cellulosic material, although other materials can be used such as polymers, particularly polypropylene or polyethylene, which may be in the form of films. As used herein, the term "cellulosic material" refers to a nonwoven web including cellulosic fibers (e.g., pulp) that has a structure of individual fibers which are interlaid, but not in an identifiable repeating manner. Such webs have been, in the past, formed by a variety of nonwoven manufacturing processes known to those skilled in the art such as, for example, air-forming, wet-forming and/or paper-making processes. Cellulosic material includes a carbohydrate polymer obtained from such feedstocks as seed fibers, woody fibers, bast fibers, leaf fibers, and fruit fibers.

The first and second primers 40 and 60 may be of any suitable material to facilitate the adherence of the first and second coatings to, respectively, the first and second surfaces 30 and 50 of the substrate 20. One preferred material is a water-based mixture including mainly clay materials. The water-based mixture can be spread on the substrate 20 and then dried. Desirably, the primers 40 and 60 may be used to buffer the active coatings 80 and 100 from the active residue in the substrate 20.

The first and second coatings 80 and 100 may include at least one imaging material or means for forming an image. The means for forming an image can be an imaging material. An imaging material can be at least one dye and/or pigment, and optionally, may include activating agents. One exemplary dye is a lueco dye. The coatings 80 and 100 may also further include at least one co-reactant chemical, such as a color developer, and at least one sensitizer chemical applied while suspended in a clay mixture in an aqueous form before being dried into solid form. Suitable lueco dyes, co-reactant chemicals, and sensitizers can be those disclosed in U.S. Pat. No. 5,883,043 issued Mar. 16, 1999; hereby incorporated by reference. To prevent the blurring of images, the first coating 80 may have a dye and/or co-reactant chemical activated at a different temperature than the dye and/or co-reactant chemical present in the second coating 100. Alternatively, the substrate 20 may have sufficient thermal resistance to prevent the heat applied to one coating to activate the dye and/or co-reactant chemical in the other coating. Thus, both coatings 80 and 100 may activate at the same temperature. Generally, the coatings 80 and 100 are less than 0.001 inch ($2.54\times10^{-45}$ meter) thick.

The topcoats 120 and 140 may include any suitable components that serve to enhance certain performance properties of the element 10. The composition of the topcoatings can vary widely to enhance various properties of the element 10, and such compositions are known to those of skill in the art. Alternatively, one of the topcoats 120 and 140 may be a backcoat provided the backcoat does not interfere with the imaging properties of the element 10. The backcoat may be applied as a water spray that includes static or abrasion reducing additives.

Figure 2:
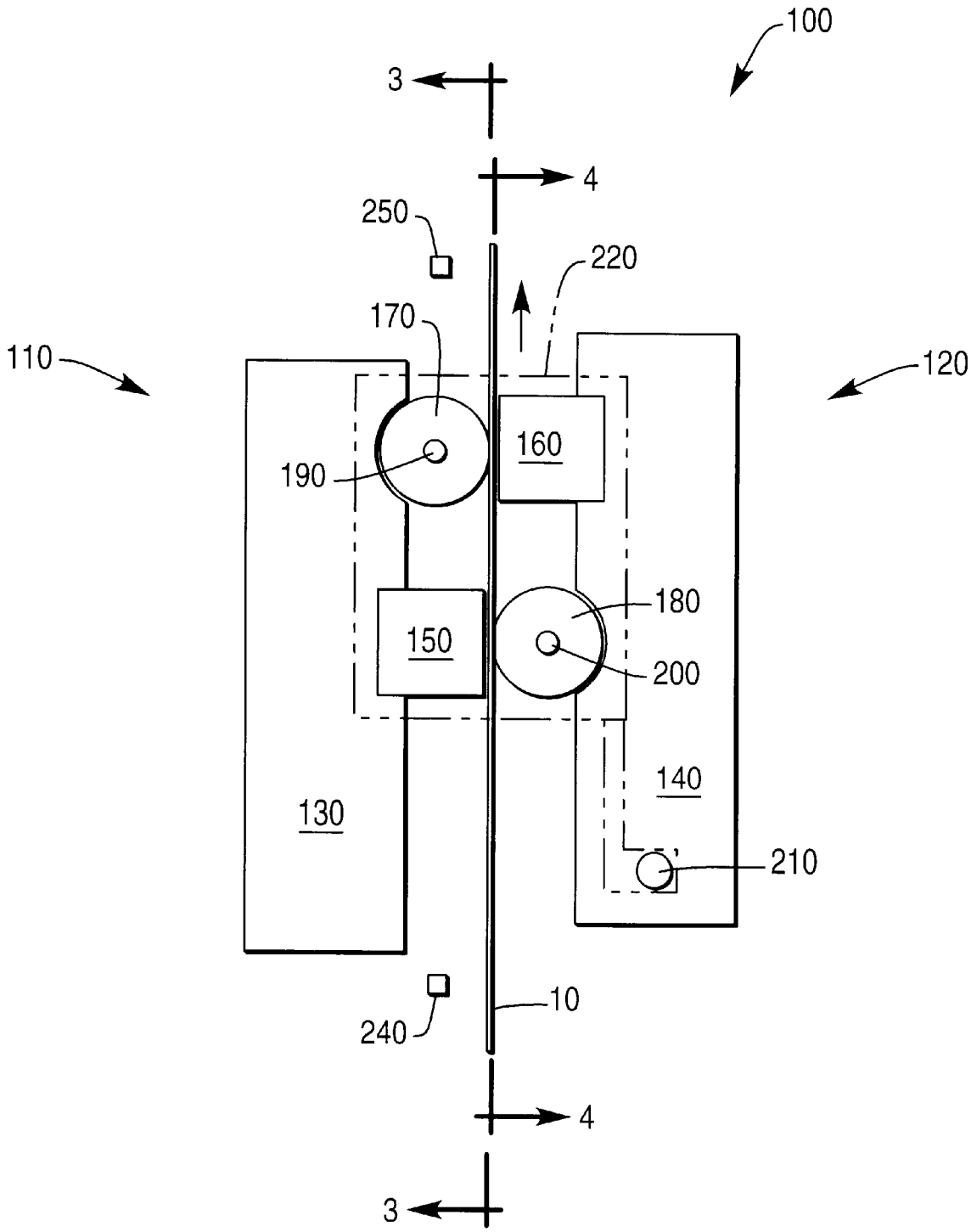
FIG. 2 illustrates a schematic, top view of an exemplary dual-sided imaging direct thermal printer with a drive assembly depicted in phantom lines.
Figure 3:
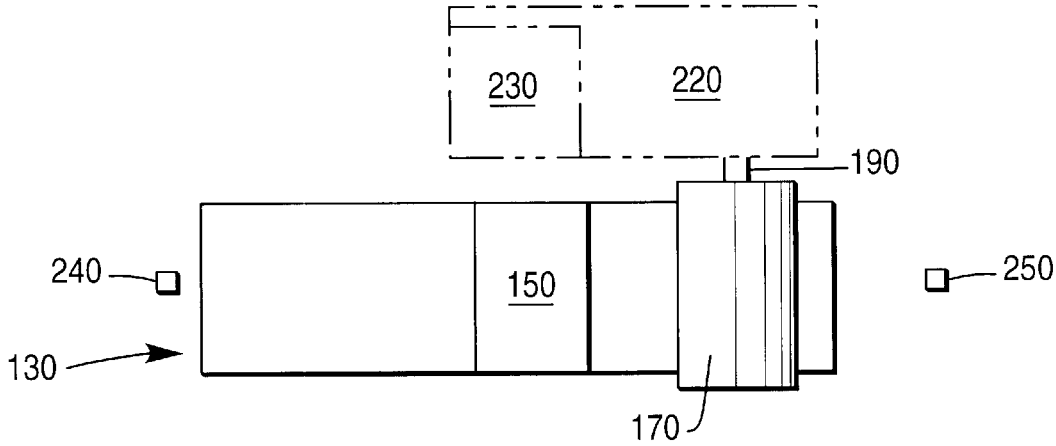
FIG. 3 illustrates a schematic of a cross-sectional view along lines 2—2 of FIG. 2 of the exemplary dual-sided imaging direct thermal printer.
Figure 4:
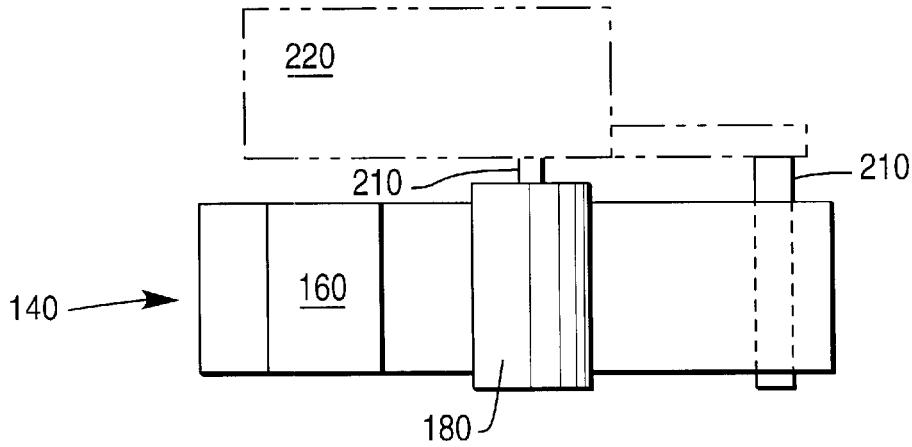
FIG. 4 illustrates a schematic of a cross-sectional view along lines 3—3 of FIG. 2 of the exemplary dual-sided imaging direct thermal printer.
Figure 5:
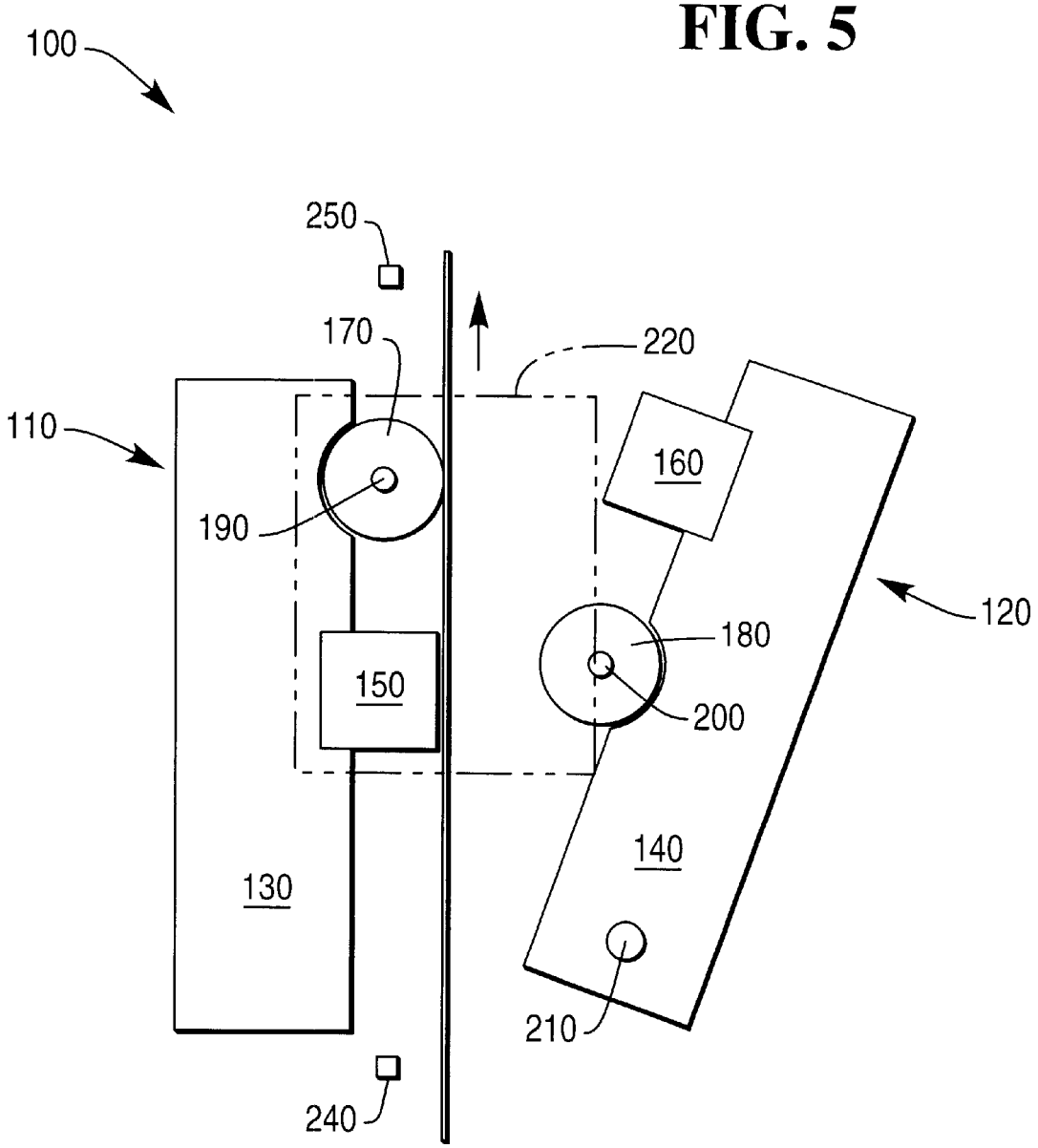
FIG. 5 illustrates a schematic, top view of the exemplary dual-sided imaging direct thermal printer depicting a second arm 140 in a rotated position away from a first arm 130.

The image element 10 is preferably printed in a suitable dual-sided imaging direct thermal printer as described herein. One preferred dual-sided imaging direct thermal printer 100 is depicted in FIGS. 2–4. The direct thermal printer 100 may include a first print head assembly 110, a second print head assembly 120, a drive assembly 220, a motor 230, and optionally, sensors 240 and 250.

The first print head assembly 110 may further include a first arm 130, a first printhead 150, and a first platen 170. The first arm 130 may be formed integrally with, or coupled to, the first printhead 150. The first printhead 150 may be any printhead suitable for direct thermal printing, such as those disclosed in U.S. Pat. No. 3,947,854 issued Mar. 30, 1976; U.S. Pat. No. 4,708,500 issued Nov. 24, 1987; and U.S. Pat. No. 5,964,541 issued Oct. 12, 1999. The first platen 170 may be substantially cylindrical in shape and journaled on a first shaft 190, which may, in turn, be coupled to the first arm 130. Preferably, the first platen 170 is rotatable about the shaft 190 for feeding an image element 10 through the printer 100.

The second print head assembly 120 may further include a second arm 140, a second printhead or a second means for direct thermal printing 160, and a second platen or second support means 180. The second arm 140 may be formed integrally with, or coupled to, the second printhead 160. In addition, the second arm 140 can be journaled on an arm shaft 210 to permit the rotation of the arm 140. In another embodiment, the first and second arms 130 and 140 are in a fixed relation. The second printhead 160 may be any printhead suitable for direct thermal printing, such as those disclosed in U.S. Pat. Nos. 3,947,854; 4,708,500; and 5,964,541. The second platen 180 may be substantially cylindrical in shape and journaled on a second shaft 200, which may, in turn, be coupled to the second arm 140. Preferably, the second platen 180, in coordination with the first platen 170, is rotatable about the shaft 200 for feeding an image element 10 through the printer 100.

A drive assembly 220 communicates with the shafts 190, 200, and 210 for rotating the platens 170 and 180, if desired, three hundred and sixty degrees; and the second arm 140, if desired, up to 170 degrees away from the first arm 130. The drive assembly 220 may be a system of gears, links, cams, or combinations thereof. The drive assembly 220, in turn, communicates with a motor 230 as depicted in FIG. 3, which is preferably electric.

The printer 100 may, optionally, include sensors 240 and 250. The sensor 240 can detect the characteristics of the image element 10 and the sensor 250 may detect image quality. In addition, another set of sensors may be placed in an opposed relation to sensors 240 and 250 on the opposite side of image element 10.

In operation, the image element 10 is fed into the printer 100 by operating the motor 230 to rotate the second arm 140 away from the first arm 130 in the position as depicted in FIG. 4. Once the image element 10 is inserted past the platens 150 and 160, the arm 140 is pivoted back to the position depicted in FIG. 1. This position of the second arm 140 pinches the image element 10 between the first printhead 150 and second platen 180, and the second printhead 160 and the first platen 170.

Next, the motor is operated to rotate the platens 170 and 180, which feeds the image element 10 past the sensor 250 as indicated by the arrow depicted in FIG. 1. As the image element passes between the first printhead 150 and the second platen 180, activating the printhead 150 will transfer heat from the printhead 150 to the image element 10, resulting in the activation of the imaging material in one of the coatings, e.g first coating 80. Once activated, the desired image will form on that coating side. The heat transfer resistance of the substrate, and/or the lower activation temperature of the imaging material with respect to the activation temperature of the imaging material in the other coating prevents an image from forming on the other side of the image element 10. Next, the image element proceeds between the printhead 160 and the platen 170 where a second image may be created on the side of image element 10 opposed to the first image. Although this image may be a mirror image of the first image to present one amplified image, desirably this second image is different from the first image to provide additional data to a user. Activating the printhead 160 will transfer heat from the printhead 160 to the image element 10, resulting in the activation of the imaging material in the other coating, e.g second coating 100. Once activated, the desired image will form on that coating side. Generally, the initial activation temperature is 150° F. (66° C.)–189° F. (87° C.), and preferably 158° F. (70° C.)–165° F. (74° C.), and the image development temperature (or optimum activation temperature) is 176° F. (80° C.)–302° F. (150° C.), preferably 190° F. (88° C.)–239° F. (115° C.), and optimally 190° F. (88° C.)–212° F. (100° C.). The initial activation temperature is the temperature where some chemical transformation begins in the first and second coatings 80 and 100, but not enough transformation occurs to render the image complete, acceptable, or legible. The image development temperature (or optimum activation temperature) is the temperature where the majority of the active ingredients have chemically reacted; e.g., the majority of the lueco dyes have changed from colorless to black.

The heat transfer resistance of the substrate, and/or the higher activation temperature of the imaging material with respect to the activation temperature of the imaging material in the other coating can prevent a premature image from forming when heating element 150 was activated. This arrangement of the printheads 150 and 160 and platens 170 and 180 can permit the substantially simultaneous printing of dual images while providing time for the first image to cure and the first side to cool prior to proceeding with the second image. Once printed, the image element 10 passes past the sensor 250 for recovery by a user.

Without further elaboration, it is believed that one skilled in the art can, using the preceding description, utilize the present invention to its fullest extent.

The entire disclosures of all applications, patents and publications, cited herein, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A direct thermal printer comprising:

a first printhead positioned proximate to a first platen;

a second printhead positioned proximate to a second platen; wherein the first printhead is in a substantially opposed relation to the second platen and the second printhead is in a substantially opposed relation to the first platen, a first printhead assembly, comprising a first arm formed integrally with the first printhead; and a second printhead assembly, comprising a second arm formed integrally with the second printhead, wherein the first platen is coupled to the first arm and the second platen is coupled to the second arm.

2. A direct thermal printer according to claim 1, wherein one of the first or second arms is journaled on an arm shaft to permit pivoting away from the other arm for feeding a direct thermal image element.

3. A direct thermal printer according to claim 1, wherein the first print head operates at a different temperature than the second print head.

4. A direct thermal printer for dual-sided imaging, comprising:

a first printhead assembly, comprising a first arm coupled or formed integrally with a first printhead, and coupled to a first platen; and a second printhead assembly, comprising a second arm coupled or formed integrally with a second printhead, and coupled to a second platen; wherein the first printhead is in a substantially opposed relation to the second platen and the second printhead is in a substantially opposed relation to the first platen.

5. A direct thermal printer according to claim 4, wherein one of the first or second arms is journaled on an arm shaft to permit pivoting away from the other arm for feeding a direct thermal image element.

6. A direct thermal printer according to claim 4, wherein the first print head operates at a different temperature than the second print head.

7. A direct thermal printer according to claim 4, wherein the first printhead assembly further comprises the first platen journaled on a first shaft whereby the first platen rotates to position a direct thermal image element for printing.

8. A direct thermal printer according to claim 7, wherein the second printhead assembly further comprises the second platen journaled on a second shaft whereby the second platen rotates in coordination with the first platen to position a direct thermal image element for printing.

9. A direct thermal printer according to claim 4, further comprising at least one drive assembly to communicate the first platen with a motor.

10. A direct thermal printer according to claim 4, wherein the first and second platens are substantially cylindrical.

* * * * *